US006958580B2

(12) United States Patent
Kamoi et al.

(10) Patent No.: US 6,958,580 B2
(45) Date of Patent: Oct. 25, 2005

(54) ELECTRONIC BALLAST FOR A HIGH INTENSITY DISCHARGE LAMP

(75) Inventors: Takeshi Kamoi, Uji (JP); Takahiro Abe, Morioka (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 10/479,042

(22) PCT Filed: Jun. 10, 2002

(86) PCT No.: PCT/JP02/05753

§ 371 (c)(1),
(2), (4) Date: Apr. 15, 2004

(87) PCT Pub. No.: WO02/104082

PCT Pub. Date: Dec. 27, 2002

(65) Prior Publication Data

US 2004/0183473 A1 Sep. 23, 2004

(30) Foreign Application Priority Data

Jun. 13, 2001 (JP) ..... 2001-178898

(51) Int. Cl.[7] ..... G05F 1/00
(52) U.S. Cl. ..... 315/291; 315/247; 315/291
(58) Field of Search ..... 315/224, 225, 315/291, 307, 219, 209 R, DIG. 4, DIG. 5

(56) References Cited

U.S. PATENT DOCUMENTS 4,910,440 A 3/1990 McMullin
5,107,184 A 4/1992 Hu et al.
5,872,429 A * 2/1999 Xia et al. ..... 315/194
5,969,484 A * 10/1999 Santi et al. ..... 315/247
6,094,017 A * 7/2000 Adamson ..... 315/307
6,181,084 B1 * 1/2001 Lau ..... 315/291

FOREIGN PATENT DOCUMENTS

JP 6-111987 A1 4/1994

OTHER PUBLICATIONS

International Search Report for PCT/JP02/05753 mailed on Oct. 9, 2002.

* cited by examiner

*Primary Examiner*—Wilson Lee
*Assistant Examiner*—Marie Antoinette Cabucos
(74) *Attorney, Agent, or Firm*—Rader, Fishman & Grauer PLLC

(57) ABSTRACT

An electronic ballast for a discharge lamp is capable of dimming the lamp over a wide range, yet assuring to operate the lamp efficiently with a minimum lamp power variation in compensation for a possible lamp characteristic variation. The ballast provides an unique voltage-wattage output characteristic which varies with a varying dimming ratio for reducing the lamp power as the dimming ratio decreases. The output characteristic is designed to follow a true lamp characteristic that the lamp voltage will decrease as the lamp power is reduced to a certain level. With this result, it is possible to give a wide voltage range within which the lamp power being supplied to the lamp is kept substantially constant irrespective of the lamp characteristic variation, thereby assuring to reduce the lamp power exactly as intended by the dimming ratio even in the presence of the lamp characteristic variation.

15 Claims, 16 Drawing Sheets

ELECTRONIC BALLAST FOR A HIGH INTENSITY DISCHARGE LAMP

TECHNICAL FIELD

The present invention relates to an electronic ballast for a high intensity discharge lamp, and more particularly to an electronic ballast with a dimmer control capability for dimming the lamp.

BACKGROUND ART

Japanese Patent Early Publication No. 6-111987 discloses a prior art electronic ballast for a high intensity discharge lamp with a dimming capability. The ballast includes a power converter which converts an input DC voltage into a lamp power for driving the lamp, a dimmer providing a dimmer command of a varying dimming ratio, and a controller which controls the power converter to reduce the lamp power as the dimming ratio decreases. A voltage monitor is included to monitor a lamp voltage across the lamp as indicative of a lamp characteristic during the dimming operation. While the lamp power is reduced to a certain level, i.e., the dimming ratio decreases from 100% down to a relatively high ratio, the controller makes a constant wattage control of varying a lamp current in accordance with the lamp voltage being monitored so as to supply a roughly constant lamp power to the lamp. As the dimming ratio decreases further, which is acknowledged by the lamp voltage exceeding a critical level, the controller switches to a constant current control of supplying a constant current only determined by the dimming ratio and not by the monitored lamp voltage in order to dim the lamp to a deeper extent without causing a lamp extinction.

The above constant wattage control during the lamp dimming is realized based upon an assumption that the lamp voltage remains substantially constant while the lamp power is reduced from a rated power to the certain level at which the lamp voltage turns to increase beyond the critical level. That is, the controller is designed to have a voltage-wattage output characteristic which gives generally quadratic function curves respectively for varying dimming ratios (a), (b), and (c), as shown in FIG. 16. These curves, which are generated in accordance with voltage-current relations determined respectively for different dimming ratios, as shown in FIG. 17, have individual apexes aligned along a fixed lamp voltage to provide an operable voltage range around the apex for each curve. The operable voltage range defines a voltage range within which a lamp characteristic curve Q1 crosses the output curves (a), (b), and (c) for operating the lamp while keeping the resulting lamp power at roughly the same level even in the presence of a possible variation in the lamp characteristic Q1. That is, when the lamp characteristic Q1 curve intersects the output curves (a), (b), (c) within the operable voltage range, only a small deviation in the lamp power is seen to assure the constant wattage control for dimming the lamp to a reduced lamp power as intended, irrespective of a possible variation in the lamp characteristic that may be caused by a lamp manufacturing process.

Although the prior art ballast teaches the constant current control for successfully dimming the lamp to a deeper extent, the above constant wattage control is not satisfactory for dimming the lamp consistently due to the fact that the lamp characteristic during the lamp dimming does actually follow a curve Q rather than Q1 as assumed in the prior art ballast. That is, the lamp voltage will decreases as the lamp power reduces from its rated power to a certain level, for example, 40% of the rated lamp power. With this result, an even slight variation in the lamp characteristic (shown for example by a curve Q2 in FIG. 16) brings about a considerable variation in the lamp power. Such considerable lamp power variation has to be avoided particularly when two or more discharge lamps are simultaneously dimmed since the lamp characteristic variation results in an appreciable lamp power difference although they are intended to be dimmed to the same level.

DISCLOSURE OF THE INVENTION

The present invention has been accomplished in view of the above insufficiency to provide an improved electronic ballast for a high intensity discharge (HID) lamp which is capable of dimming the lamp over a wide range, yet assuring to operate the lamp efficiently with a minimum lamp power variation in the presence of a possible variation in the lamp characteristic. The ballast in accordance with the present invention includes a power converter which converts an input DC voltage into a lamp power for driving the high intensity discharge lamp, a dimmer which provides a dimmer command of a varying dimming ratio in order to reduce the lamp power for dimming the lamp to a deeper extent as the dimming ratio decreases. Also included in the ballast are a voltage monitor for monitoring a lamp voltage across the discharge lamp, and a controller which controls the power converter to provide a voltage-wattage output characteristic which gives a lamp power varying with the varying lamp voltage being monitored. The controller receives the dimmer command and provides the voltage-wattage output characteristic which lowers the lamp power for the given monitored lamp voltage as the dimming ratio decreases. The voltage-wattage output characteristic of the ballast defines an effective constant wattage control (ECWC) voltage range within which the power converter is controlled to give a roughly constant lamp power, while allowing only a small lamp power error from a maximum lamp power when the monitored lamp voltage varies between a lower bound and an upper bound of said ECWC voltage range due to a possible variation in the lamp characteristic. The lamp power error is selected, for example, to correspond to about 5% or less of the maximum lamp power intended by the given dimming ratio. The important feature of the present invention resides in that the controller operates to modify the voltage-wattage output characteristic in such a manner as to lower the lower bound of the ECWC voltage range as the dimming ratio decreases down from 100% at which a rated power is supplied to the discharge lamp. This means that the ECWC voltage range is shifted to a lower voltage side as the dimming ratio decreases in an exact match with an actual lamp characteristic experienced during the lamp dimming. Whereby, it is possible to minimize the lamp power variation at any applicable dimming ratio, i.e., reduced lamp power level, even in the presence of a possible lamp characteristic variation caused by a lamp manufacturing process. Therefore, the lamp can be dimmed to an exact level as intended by the dimming ratio, while compensating for any allowable lamp characteristic variation. Accordingly, when two or more lamps are dimmed to the same dimming ratio, their output powers can be reduced to the same level consistently, i.e., without causing any appreciable output power difference.

The controller operates to lower the lower bound of the ECWC voltage range until the dimming ratio decreases to a predetermined level below which the lamp voltage of the lamp turns to increase with a further decreasing of the lamp power. The predetermined level is selected to correspond to a lamp power as intended by the dimming ratio of 30 to 50%, above which the lamp voltage decreases with the decreasing lamp power and below which the lamp voltage increases with the decreasing lamp power. In this connection, the controller gives the ECWC voltage range of which lower bound is shifted by approximately 20 V when the dimming ratio decreases from 100% to 50%.

Preferably, the controller has an additional function of controlling the power converter to provide a constant current control for supplying to the discharge lamp a constant current determined solely by the dimming ratio and not by the instant lamp voltage being monitored. Once the dimming ratio is lowered past the predetermined level, the controller switches the constant wattage control to the constant current control for further reducing the lamp power successfully to a deeper extent.

The constant current control is designed to restrict the constant current such that the constant current gives a resulting lamp power not exceeding the lamp power given to the discharge lamp when it is operated at the dimming ratio of 100%. With this design, the ballast can be made safe not to apply an excessively high power at the deep dimming ratio where the lamp exhibits the increased lamp voltage.

In another version, the controller may be designed to give the effective constant wattage control (ECWC) voltage range having a width which increases as the dimming ratio decreases down from 100%. This is particularly advantageous in compensating for the lamp characteristic having a greater variation as the dimming ratio decreases. In this connection, the effective constant wattage control voltage range may be defined as a range within which the lamp power is substantially fixed irrespective of the lamp voltage varying from the lower bound to the upper bound. Thus, a true constant wattage control can be realized during the lamp dimming even in the presence of the lamp characteristic variation, assuring a consistent dimming control in an exact correspondence to the selected dimming ratio.

Also in this version, the controller is preferred to restrict the lamp power in the course of dimming the discharge lamp such that the lamp power, which is given to the lamp as corresponding to the lamp voltage varying with the dimming ratio, does not exceed the rated lamp power given to the lamp when it is operated at the dimming ratio of 100%.

The controller may be further added with the above constant current control which takes over the constant wattage control after the dimming ratio decreases past the predetermined level at which the lamp voltage turns to increase with a further decrease of the lamp power.

Further, the above constant current control is preferably made to restrict the constant current such that the constant current gives a resulting lamp wattage not exceeding the lamp wattage given to the discharge lamp when it is operated at the dimming ratio of 100%.

A more complete appreciation of the invention and many of the attendant advantages thereof will become readily apparent with reference to the following detailed description, particularly when considered in conjunction with the accompanying drawings.

DETAILED DESCRIPTION OF THE EMBODIMENTS

Figure 1:
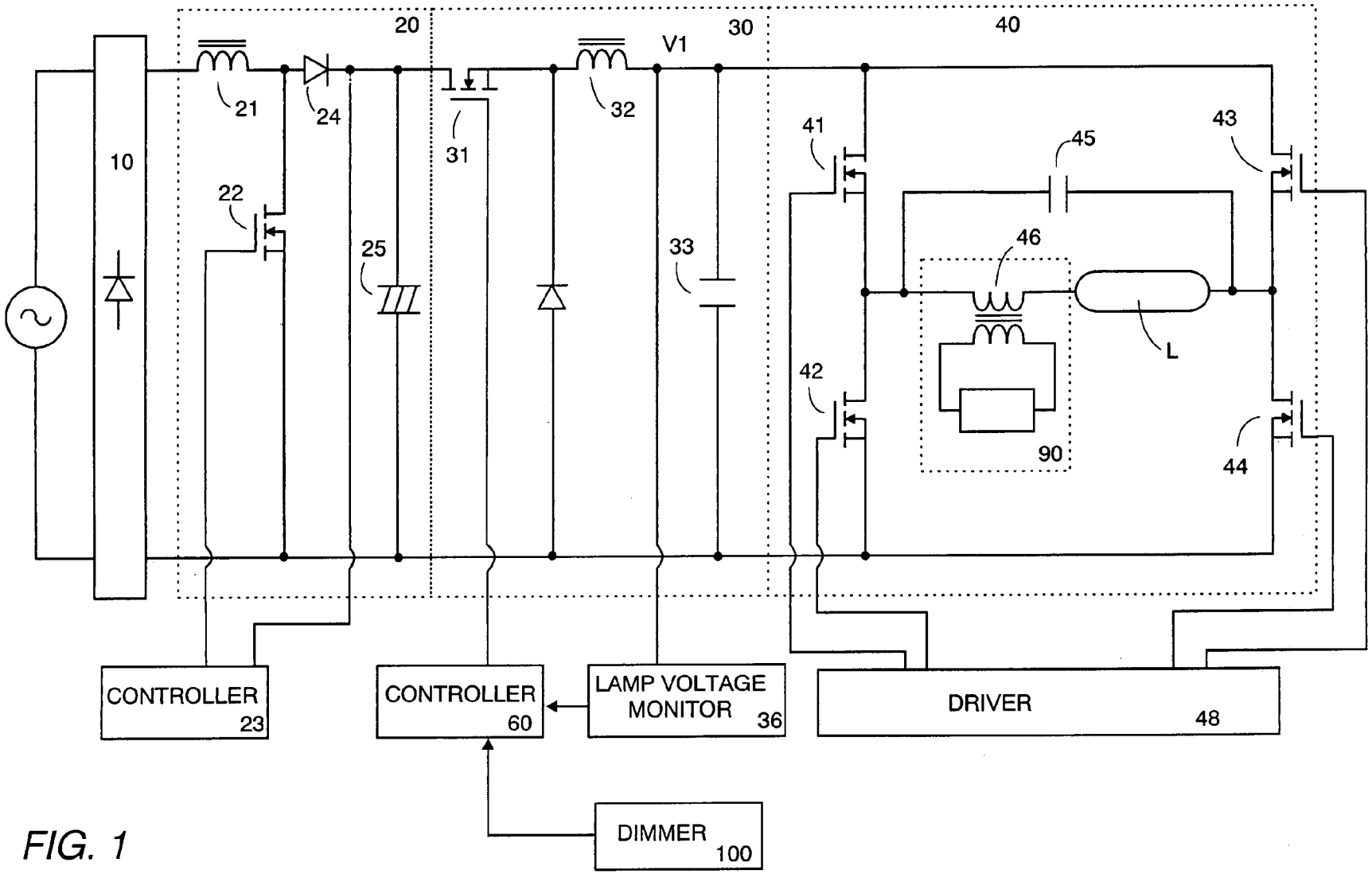
FIG. 1 is a circuit diagram of an electronic ballast in accordance with a first embodiment of the present invention.

The preferred embodiments will now be described with reference to the accompanying drawings, wherein like reference numerals designate corresponding or identical elements throughout the various drawings.

First Embodiment <FIGS. 1 to 6>

Referring now to FIG. 1, there is shown an electronic ballast for a high intensity discharge lamp in accordance with a first embodiment of the present invention. The ballast is designed to operate a high intensity discharge (HID) lamp including the metal halide HID lamp. The ballast includes a rectifier 10 adapted to connected to an AC mains to provide a rectified DC voltage, a boost converter 20 for converting the rectified DC voltage into a boosted voltage, a buck converter 30 for converting the boosted voltage into a regulated DC voltage, an inverter 40 for converting the regulated DC voltage into a low frequency AC voltage of rectangular waveform which is applied to a lamp L for operating the same, and an igniter 90 for igniting the lamp. The boost converter 20 includes an inductor 21 and a transistor switch 22 which are connected in series across the rectifier 10. The switch 22, which is a MOSFET (Metal-Oxide semiconductor Field Effect Transistor), is controlled by a controller 23 to turn on and off at a high frequency to accumulate the resulting voltage into a smoothing capacitor 25 through a diode 24. The controller 23 monitors the voltage across the capacitor 24 to keep the output DC voltage at a constant level in a feedback manner.

The buck converter 30 includes a transistor switch 31 connected in series with an inductor 32, and a smoothing capacitor 33 across the smoothing capacitor 25. The switch 31 made of MOSFET, is controlled by a controller 60 to turn on and off at a varying duty ratio to supply a varying current and voltage to the inverter 40 through the inductor 32 and the capacitor 33. In this sense, the buck converter 30 acts as a power converter which varies a lamp current or lamp power being supplied to the lamp L through the inverter 40. A lamp voltage monitor 36 is included to monitor the voltage V1 across the smoothing capacitor 33 as indicative of the lamp voltage Vla being applied to the lamp L. Based upon the monitored voltage, the controller 60 operates to vary the lamp power in accordance with a predetermined pattern in order to ignite and keep operating the lamp.

The inverter 40 includes a first pair of switches 41 and 42 connected in series across the capacitor 33, and second pair of switches 43 and 44 connected in series across the capacitor 33 in parallel with the first pair. The switches 41 to 44 are each realized by MOSFET. Also included in the inverter is a capacitor 45 connected across the lamp L, and an inductor 46 which is connected in series with the lamp L between a connection point of switches 41 and 42 and a connection point of switches 43 and 44. The switches 41 to 44 are driven by a driver 48 to turn on and off repetitively for supplying the resulting AC current Ila to the lamp L. In detail, a diagonally opposed pair of switches 41 and 44 are simultaneously turned on and off at a low frequency in an alternating fashion with another diagonally opposed pair of switches 42 and 43 which are also turned on and off simultaneously at the low frequency. The network of switches 41 to 44 may be controlled in such a manner that one switch of each diagonally opposed pair is driven at a high frequency while the other switch is turned on at a low frequency, and that the low frequency driven switch in one diagonally opposed pair is turned on and off at the low frequency in alternating relation with the low frequency driven switch in the other diagonally opposed pair. In this modification, the high frequency driven switches can be utilized as an alternative to the switch 31 of the buck converter 30. Although the illustrated embodiment utilizes the inverter 40 of a full-bridge configuration, it is equally possible to utilize an inverter of a half-bridge configuration. Further, the switches 41 to 44 may be each realized by a bipolar transistor with a diode connected in an anti-parallel relation across the transistor.

The ballast includes a dimmer 100 which gives a dimmer command of a variable dimming ratio which is defined in the description to be a ratio of a reduced lumens to a rated lumens, i.e., the reduced lamp power to a rated lamp power. For easy reference purpose, the dimming ratio is expressed in term of a percentage throughout the description. For example, 80% dimming ratio means 80% of the rated lamp power or lumens. The dimmer 100 is accessible by a user to adjust the dimming ratio. Upon receiving the dimmer command of thus adjusted dimming ratio, the controller 60 lowers the duty cycle of the switch 31 responsible for providing the voltage V1, thereby lowering the lamp current being supplied to the lamp for dimming the lamp.

Figure 2:
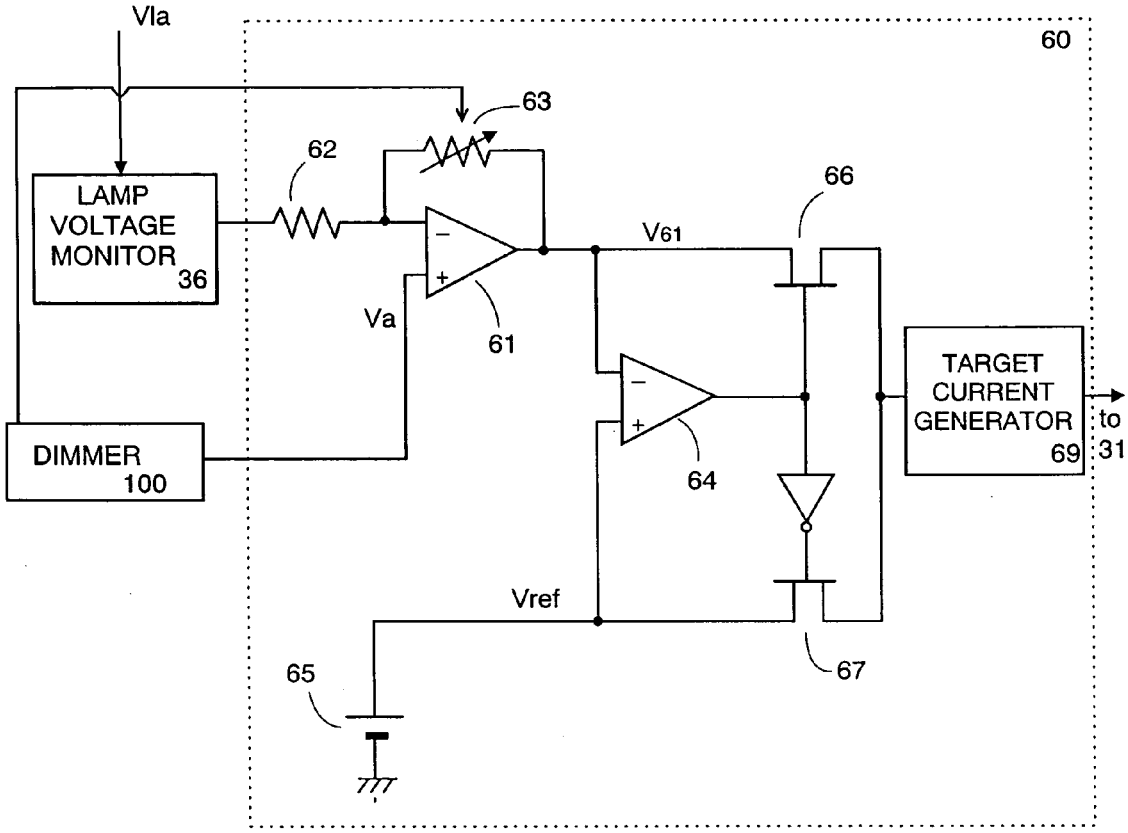
FIG. 2 is a circuit diagram of a controller utilized in the above ballast.
Figure 3:
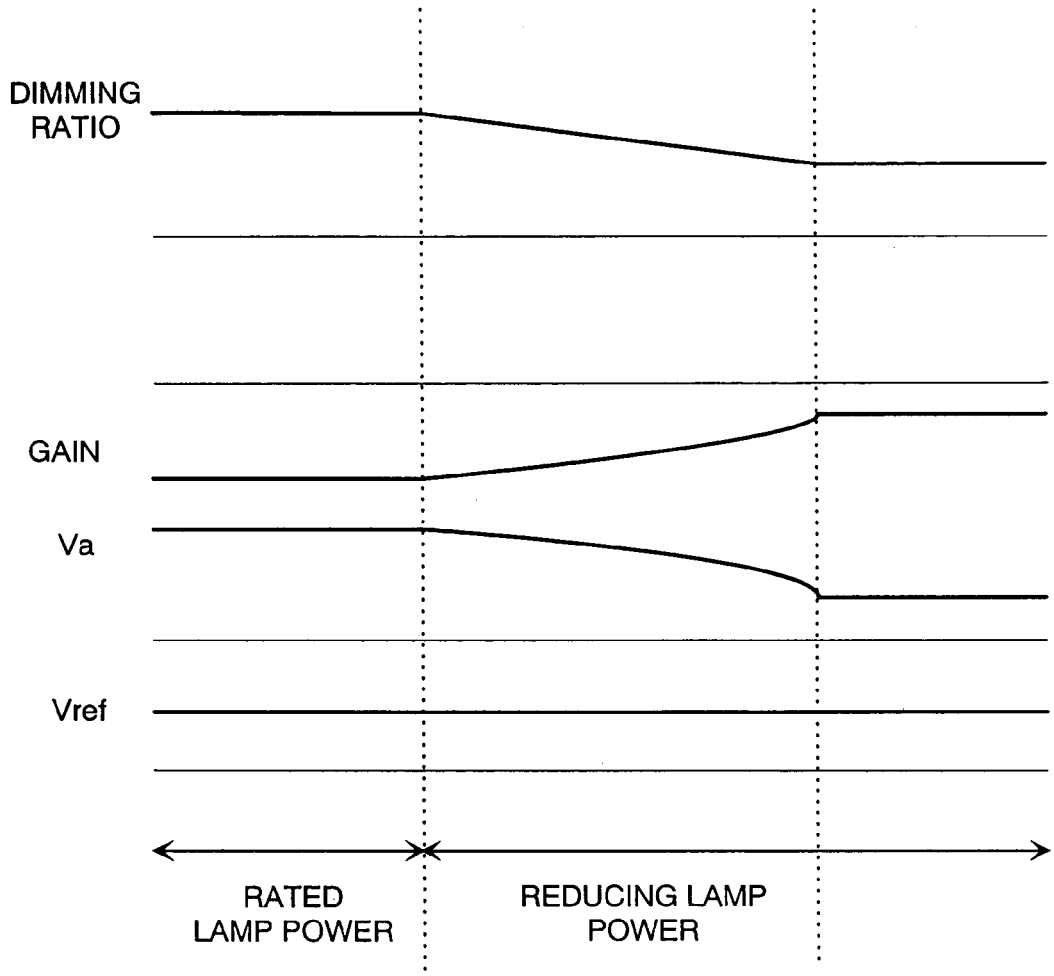
FIG. 3 is a waveform chart illustrating the operation of the controller.
Figure 4:
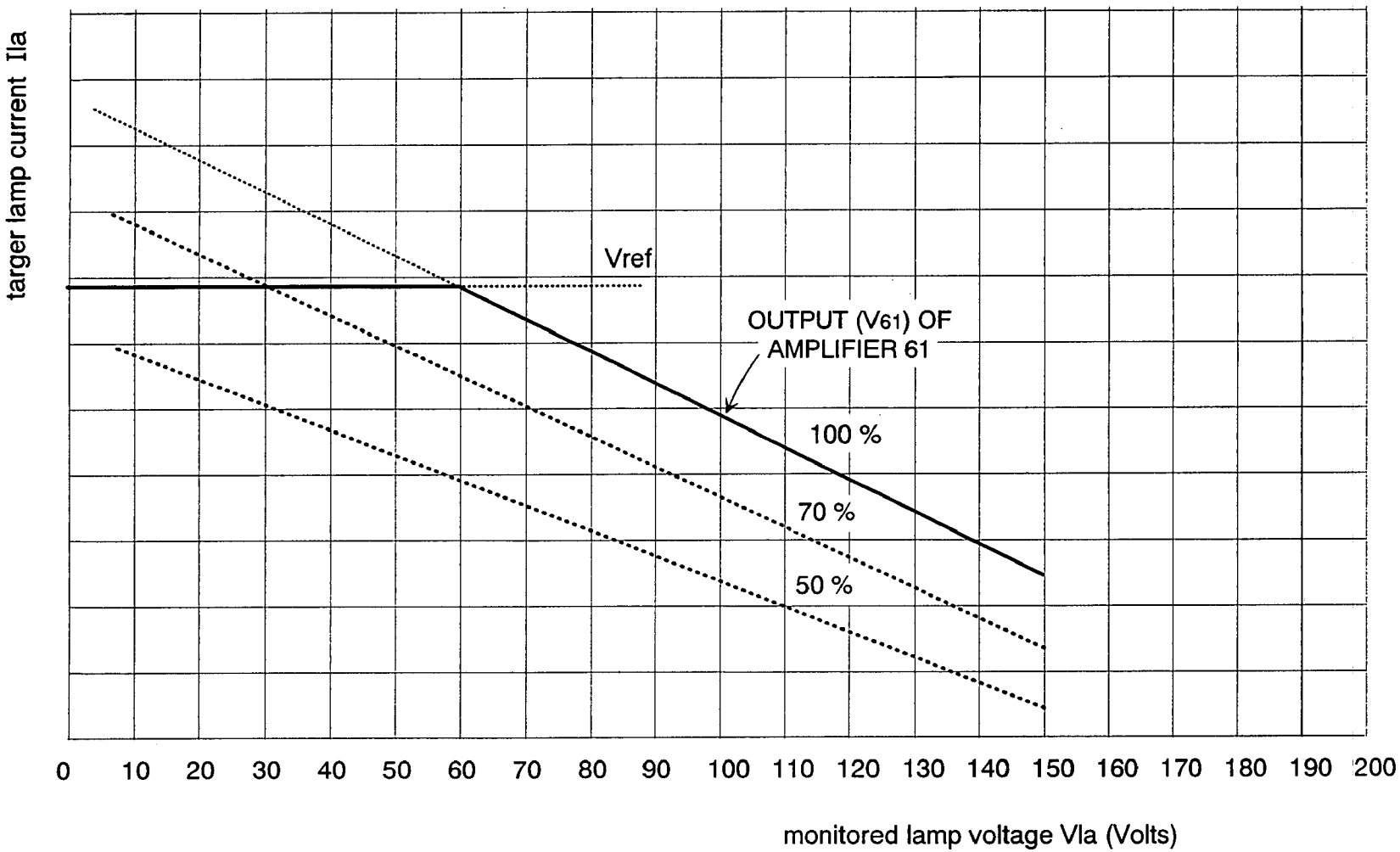
FIG. 4 is a graph illustrating the operation of the controller.

Now referring to FIG. 2, details of the controller 60 will be discussed herein. Basically, the controller 60 is designed to make a constant wattage control of providing a roughly constant lamp power or lumen as intended by the dimming ratio selected, while compensating for a possible variation in lamp characteristic regarding a voltage-wattage relation inherent to the lamp. The controller 60 includes a differential amplifier 61 having an inverting input receiving the monitored lamp voltage Vla from the lamp voltage monitor 36 through an input resistor 62, and an non-inverting input receiving a voltage Va indicative of the varying dimming ratio. A variable feedback resistor 63 is connected across the inverting input and an output of the amplifier 61 to vary a gain of the amplifier in accordance with the dimming ratio. As shown in a waveform chart of FIG. 3, the dimmer 100 gives the voltage Va which is lowered with the decreasing dimming ratio and which decreases the gain of the amplifier 61 with the decreasing dimming ratio. The output V61 of the amplifier 61 is compared at a comparator 64 with a reference voltage Vref from a voltage source 65 such that the output V61 of the amplifier 61 is supplied to a target current generator 69 through a transistor 66 while the output V61 is lower than the reference voltage Vref. Otherwise, the reference voltage Vref is fed to the generator 69 through a transistor 67, as shown in FIG. 4. The output V61 of the amplifier 61 or the reference voltage Vref indicates a target lamp current which the buck converter 30 is controlled to provide. That is, the generator 69, in response to the output V61 of the amplifier and the reference voltage Vref, controls the transistor switch 31 of the buck converter 30, i.e., the power converter to provide the lamp current to the lamp through the inverter 40.

Figure 5:
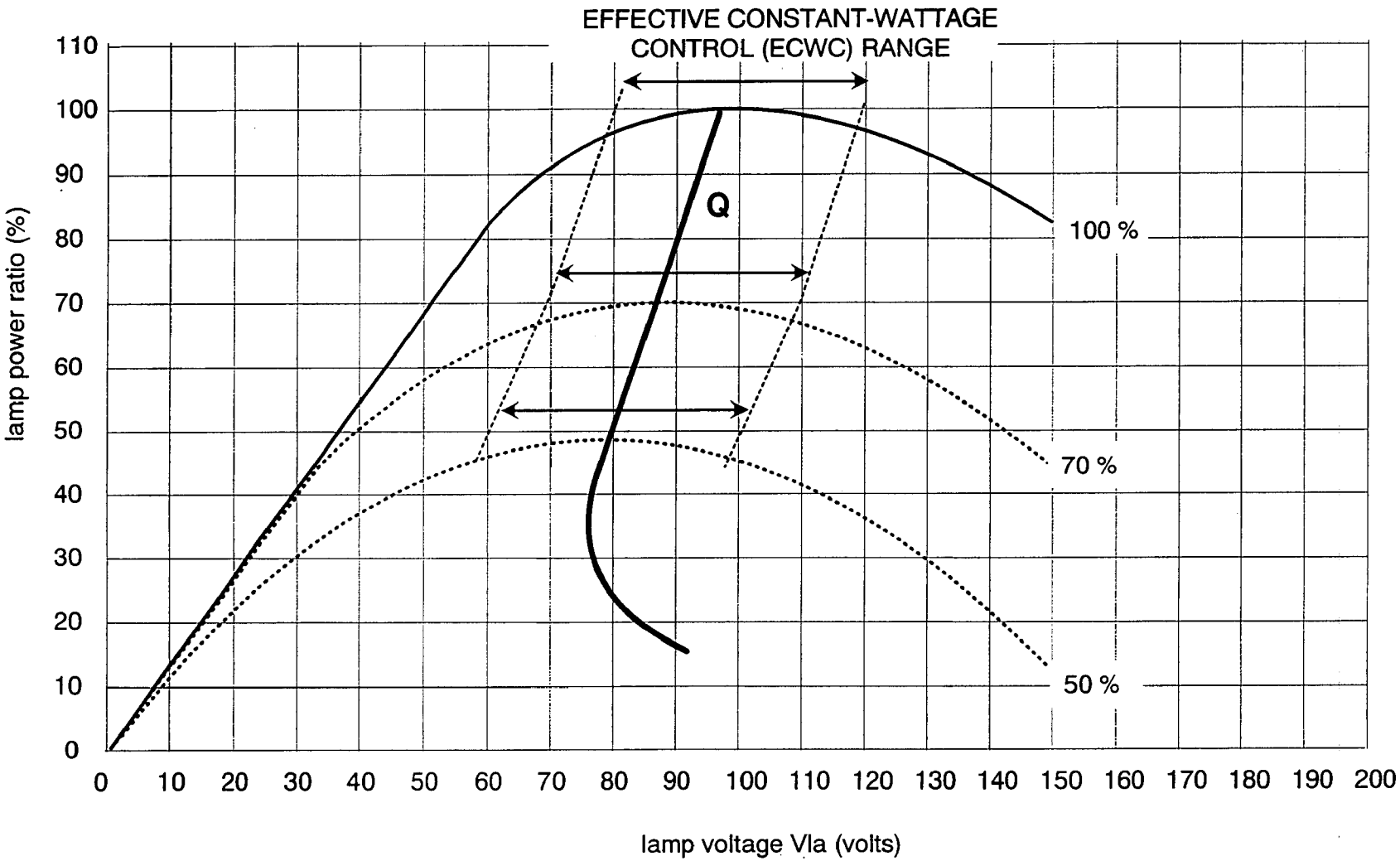
FIG. 5 is a graph illustrating the operation of the ballast.
Figure 6:
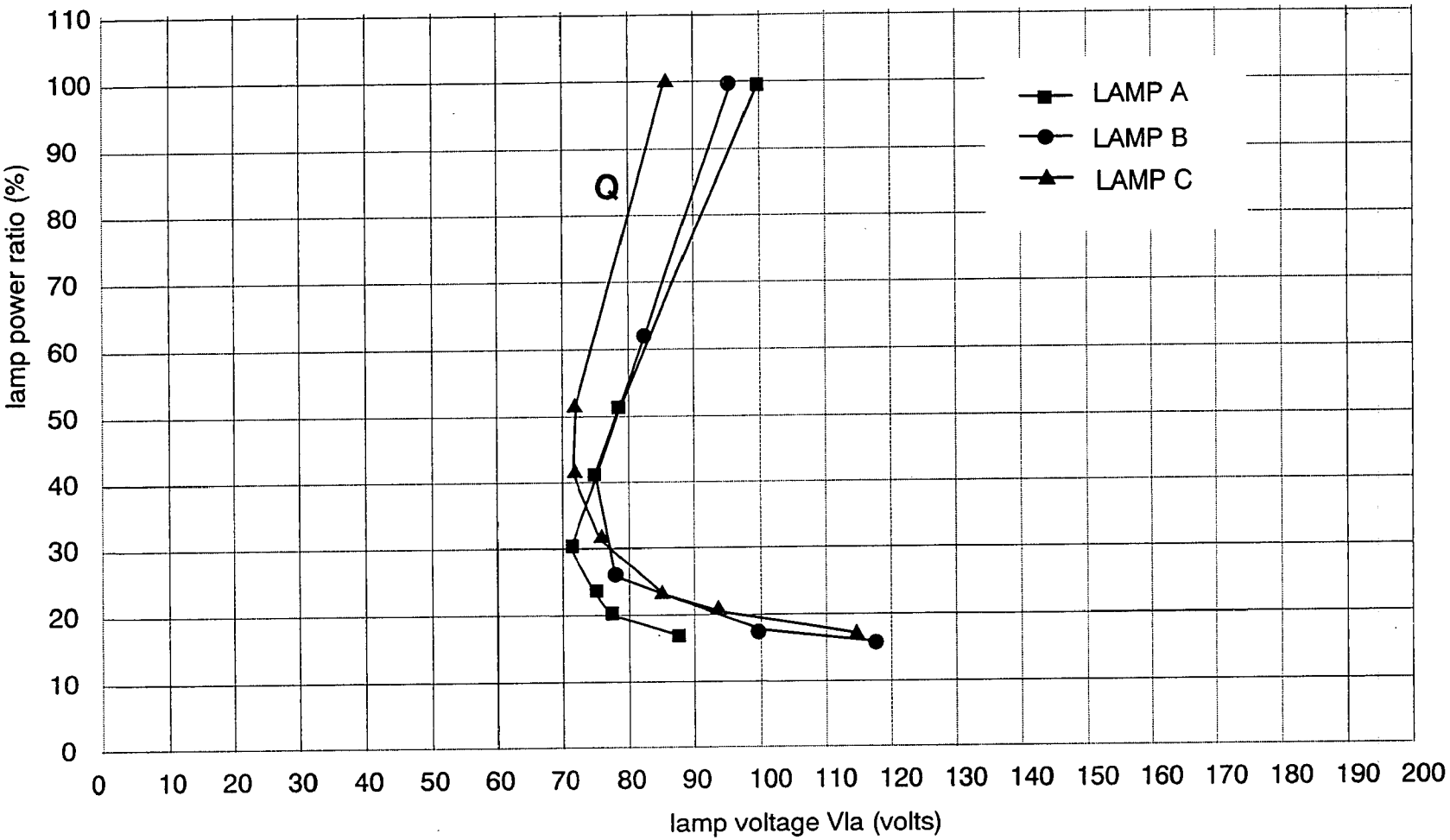
FIG. 6 is a graph illustrating a possible lamp characteristic variation.

As shown in FIG. 4, the output V61 of the amplifier 61, i.e., the target lamp current increases with the decreasing lamp voltage while the output V61 of amplifier 61 is below a level defined by the reference voltage Vref in order to achieve the constant-wattage control. An inclined solid line in the figure indicates a voltage-current relation given by the output V61 of the amplifier 61 at the dimming ratio of 100%. As the dimming ratio decreases, the above relation varies as indicated by inclined dotted lines respectively marked with the dimming ratios of 70% and 50% in the figure. It is noted in this connection, a horizontal line marked by Vref indicates that the ballast is controlled to make a constant current control of providing a constant lamp current in a lamp starting period for achieving a transition of the lamp ignition stage to a stable lamp operation stage. With this constant wattage control, the ballast provides a voltage-wattage output characteristic for each dimming ratio, as shown in FIG. 5. The output characteristic thus given to the ballast defines an effective constant-wattage control (ECWC) voltage range within which the lamp power varies only within a small lamp power error from a maximum lamp power as the monitored lamp voltage varies. The lamp power error is selected to correspond to 5% or less of the maximum lamp power obtained by the output characteristic for each dimming ratio. It is within this ECWC voltage range that a roughly the same lamp power is applied to the lamp irrespective of the variation in the lamp voltage being monitored as a result of the lamp characteristic variation that may be caused by a lamp manufacturing process. As a result of that the line defining the voltage-current relation of the output of the amplifier 61 is designed to be lowered as the dimming ratio decreases, as seen in FIG. 4, the ECWC range shown in FIG. 5 is shifted to a lower voltage side as the dimming ratio decreases, thereby exactly following a general lamp characteristic Q curve with regard to voltage-wattage relation which the lamp is assumed to exhibit during the lamp dimming. Therefore, the ballast can provide the output characteristic which can compensate for a wide variation in the lamp characteristic, while dimming the lamp at the dimming ratio of from 100% to about 50%. In fact, although the lamps of the same rating may have some variations in the lamp characteristics, an experiment shows that the lamps exhibit a general tendency that the lamp voltage decreases as the lamp power decreases down to a certain level, say about 30 to 50%, as shown in FIG. 6 in which lamps A to C are of the same rating available from Matsushita Electric Industrial Co., Ltd. Lamps A and B are indentifed by model no. "MT150CE-WW", while lamp C is identified by model no. "MT150CE-LW". Thus, the above control of shifting the ECWC range, particularly the lower bound thereof is specifically advantageous for reducing the lamp power in accordance with the dimming ratio, causing no substantial lamp power difference even in the presence of the lamp characteristic variation. It is noted that the ECWC range becomes somewhat wider as the dimming ratio decreases, because of that, as the dimming ratio decreases, the gain of the amplifier 61 decreases with an attendant decrease in the gradient of the line shown in FIG. 4 as indicative of the output V61 of the amplifier 61, which results in the flattening of the curve of the output characteristic shown in FIG. 5.

Second Embodiment <FIGS. 7 to 10>

Figure 7:
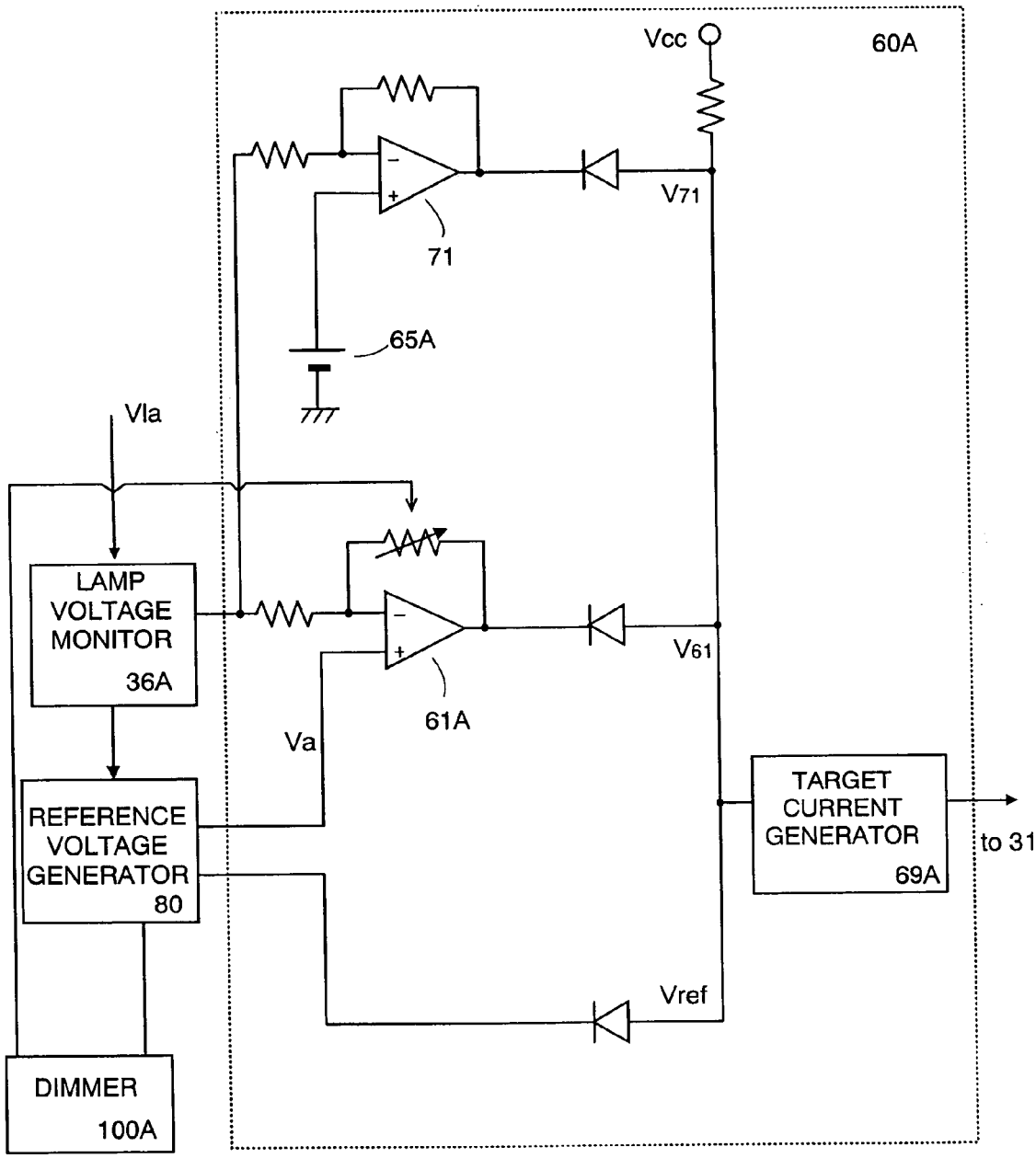
FIG. 7 is a circuit diagram of a controller for an electronic ballast in accordance with a second embodiment of the present invention.
Figure 8:
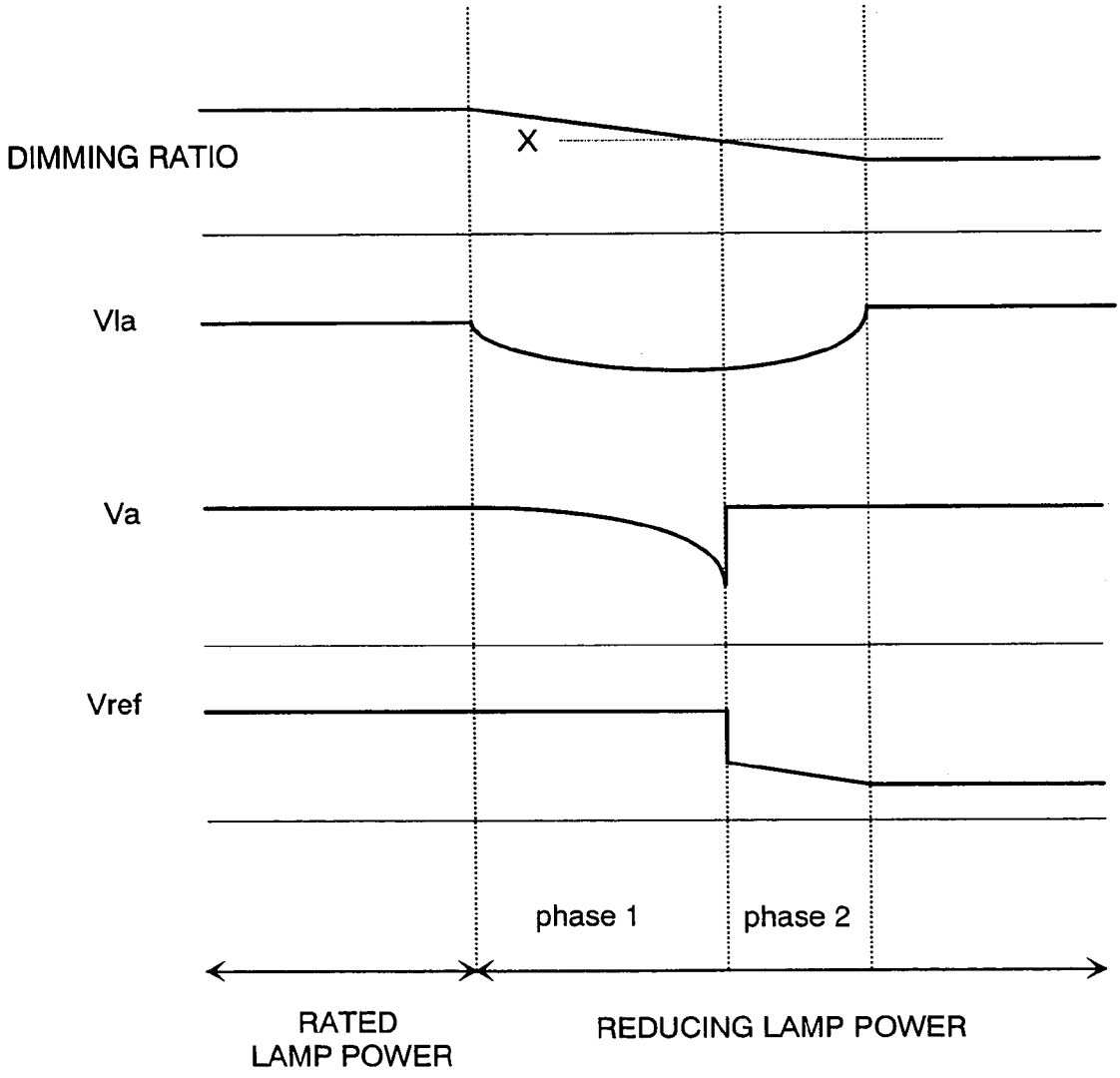
FIG. 8 is a waveform chart illustrating the operation of the controller.

Referring to FIG. 7, there is show a controller 60A for an electronic ballast in accordance with a second embodiment of the present invention. The controller 60A is basically identical in function to that of the first embodiment except that it gives a constant current control when the dimming ratio is further lowered past a predetermined level around 30% to 50%. Like parts are designated by like reference numerals with a suffix letter of "A". The controller 60A includes an amplifier 71 which provides an output V71 in reverse proportion to the lamp voltage Vla monitored by lamp voltage monitor 36A, as shown by an inclined solid line in FIG. 9, an amplifier 61A which provides an output V61 also in reverse proportion to the lamp voltage Vla, as shown by inclined dotted lines in FIG. 9. The output V61 is lowered as the dimming ratio decreases as is explained with respect to the first embodiment. The amplifier 61A has its non-inverting input connected to receive a voltage Va indicative of the dimming ratio from a reference voltage generator 80 which receives the dimmer command from the dimmer 100A. The reference voltage generator 80 is connected to receive the lamp voltage Vla and the dimmer command to provide the voltage Va which varies with the dimming ratio as long as the dimming ratio is above the predetermined level X of about 30% to 50%. The voltage Va is fixed after the dimming ratio is lowered past the predetermined level X or the monitored lamp voltage turns to increase. That is, the voltage Va fed to the amplifier 61A decreases with the decreasing dimming ratio or the lamp power during a phase 1, and is fixed during a phase 2 for further lamp dimming, as shown in a waveform chart of FIG. 8. Also, the reference voltage generator 80 gives the reference voltage Vref which is fixed during phase 1 and decreases with the decreasing dimming ratio during phase 2.

Figure 9:
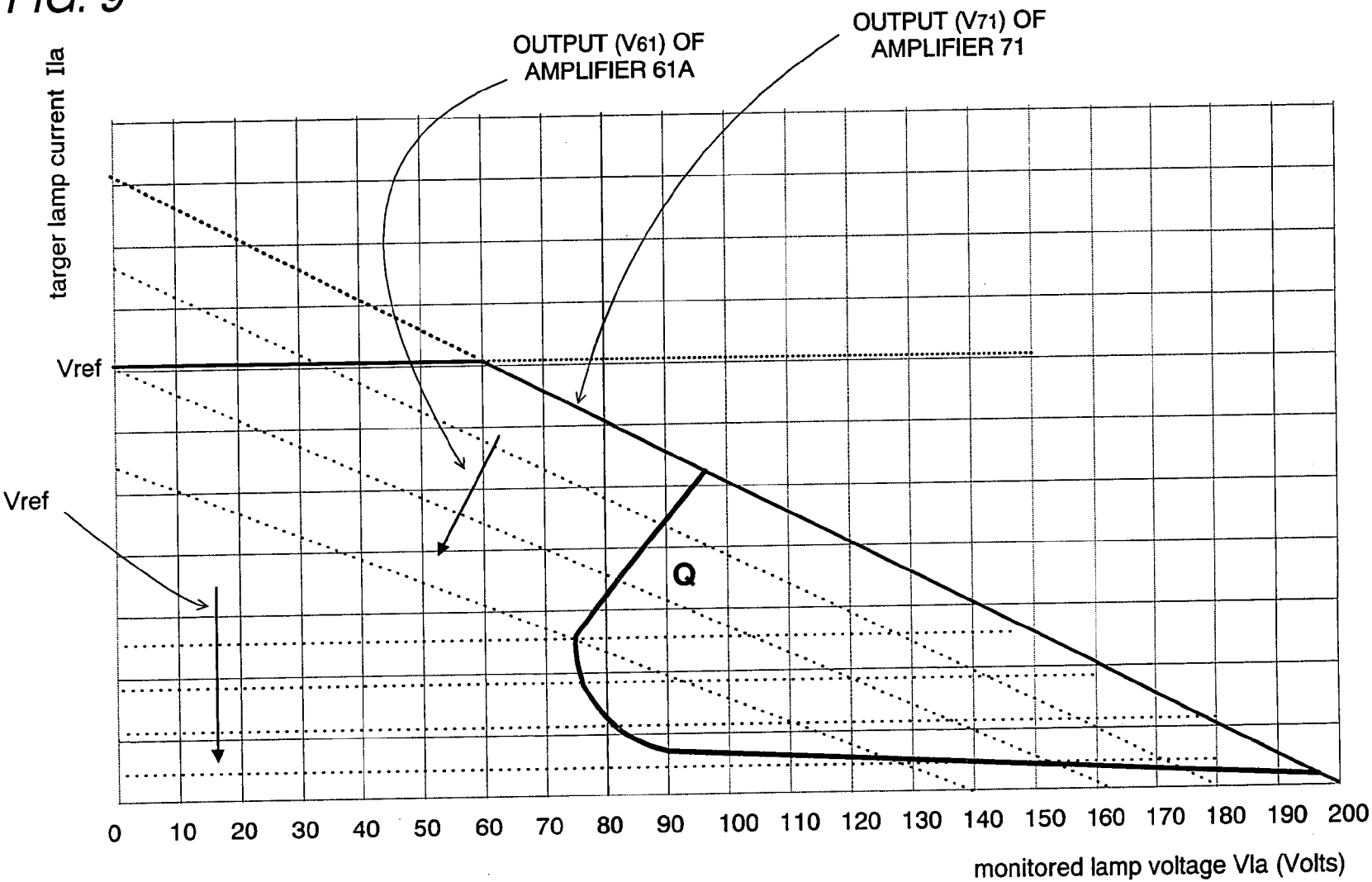
FIG. 9 is a graph illustrating the operation of the controller.
Figure 10:
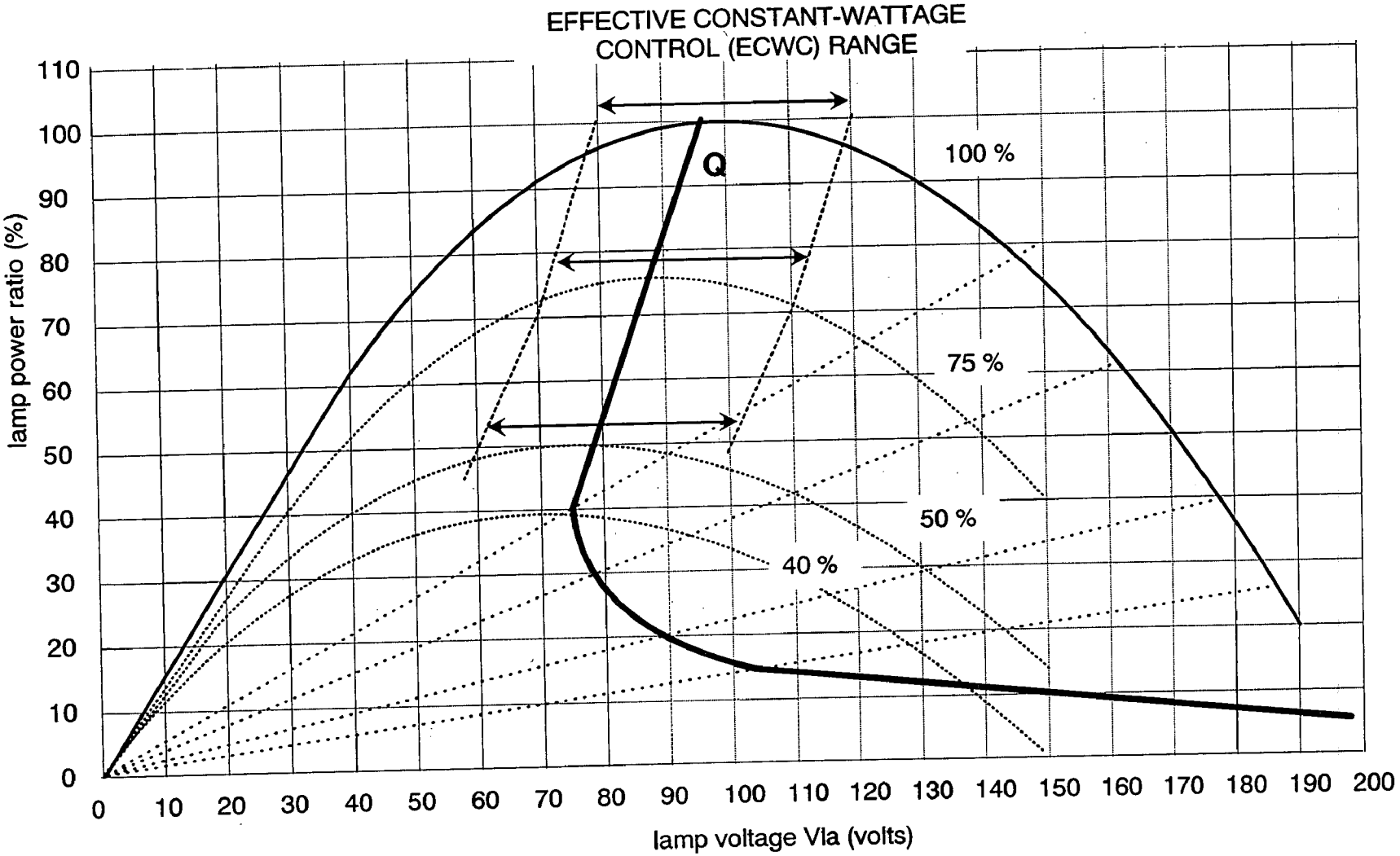
FIG. 10 is a graph illustrating the operation of the ballast.

A target current generator 69A is connected in circuit to receive a lowest one of the output V71 of the amplifier 71, the output V61 of the amplifier 61A, and the reference voltage Vref in order to give a corresponding control signal to the switch 31 of the power converter, providing a voltage-current relation as shown in FIG. 9, in which an inclined solid line indicates the output V71 of the amplifier 71 for the constant-wattage control at the dimming ratio of 100%, a horizontal solid line indicates the fixed reference voltage Vref for the constant current control made for smooth transition of the lamp igniting to the stable lamp operation. Inclined dotted lines indicate the output V61 of the amplifier 61A for the constant-wattage control at the lowered dimming ratios of 75%, 50%, 40%, and dotted horizontal lines indicate the lowering reference voltage Vref for the constant current control at the lowered dimming ratios. Thus, the ballast provides the output characteristic with regard to the voltage-wattage relation as shown in FIG. 10. Accordingly, the ballast makes the constant-wattage control as the dimming ratio down to about 40% with an attendant shifting of the effective constant-wattage control (ECWC) voltage range to the lower voltage side, and switches into the constant current control for providing a constant current as determined by the dimming ratio while the lamp is dimmed to a deeper extent. The constant current control is indicated by dotted straight lines of differing gradients in FIG. 10 from which it is readily confirmed that the lines intersect the lamp characteristic curve Q successfully at steep angles, which means that the ballast can be easy to find an operating point for the lamp even after the lamp voltage turns to increase as a result of the lamp being dimmed to a deeper extent. In this connection, it is noted that although the constant current will increase the resulting lamp power with the increasing lamp voltage during the constant current control, the constant current is restricted such that the resulting lamp power will not exceed the lamp power given to the lamp when it is operated at the dimming ratio of 100%. The reason is that the current generator 69A operates to vary the lamp current only in response to a minimum of the output V71 of the amplifier 71 responsible for the output characteristic in the constant-wattage control at 100% dimming ratio, the output V61 of the amplifier 61A responsible for the output characteristic in the constant-wattage control at reduced dimming ratio, and the lowering reference voltage Vref responsible for the output characteristic in the constant current control.

Figure 11:
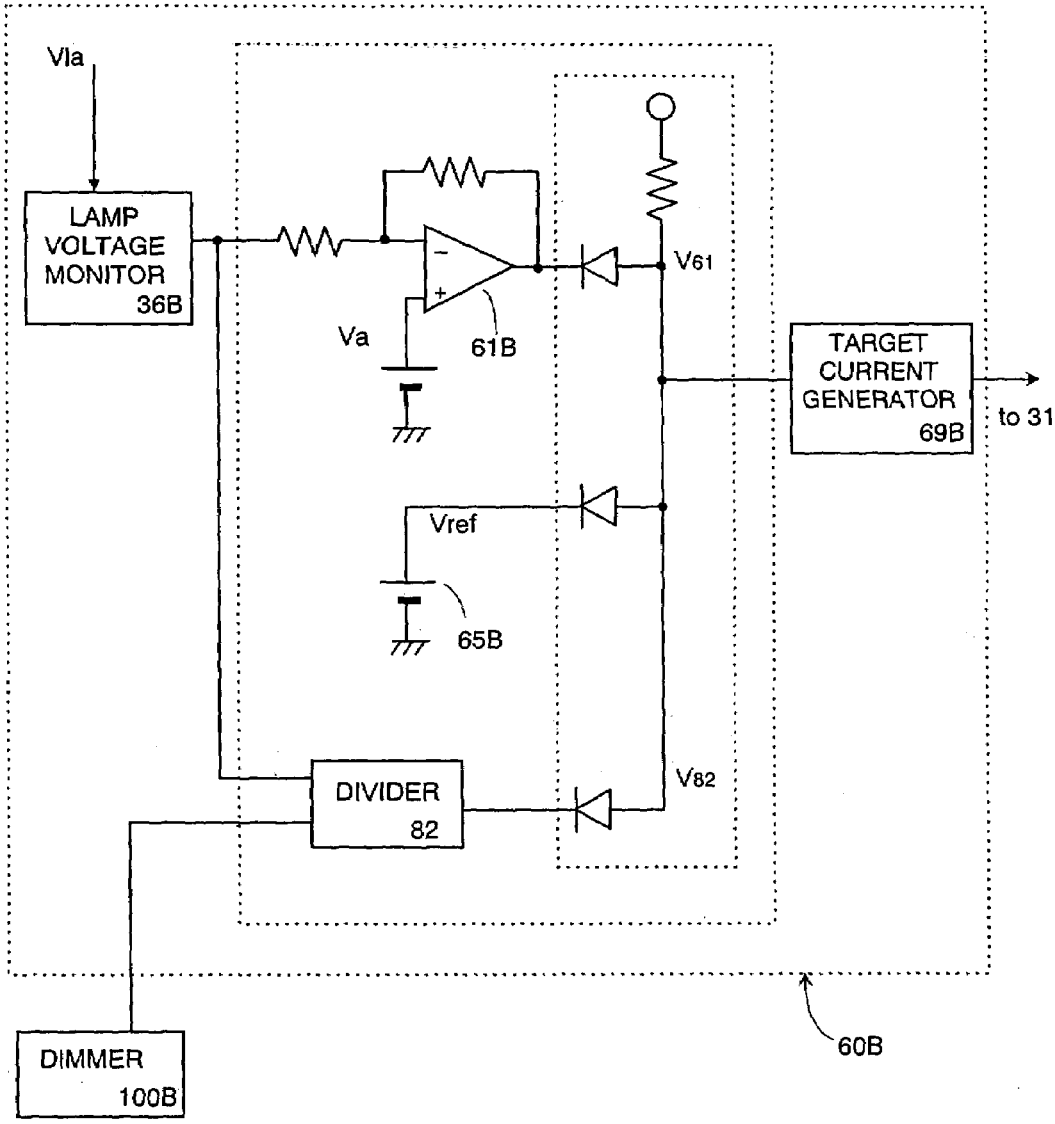
FIG. 11 is a circuit diagram of a controller for an electronic ballast in accordance with a third embodiment of the present invention.
Figure 12:
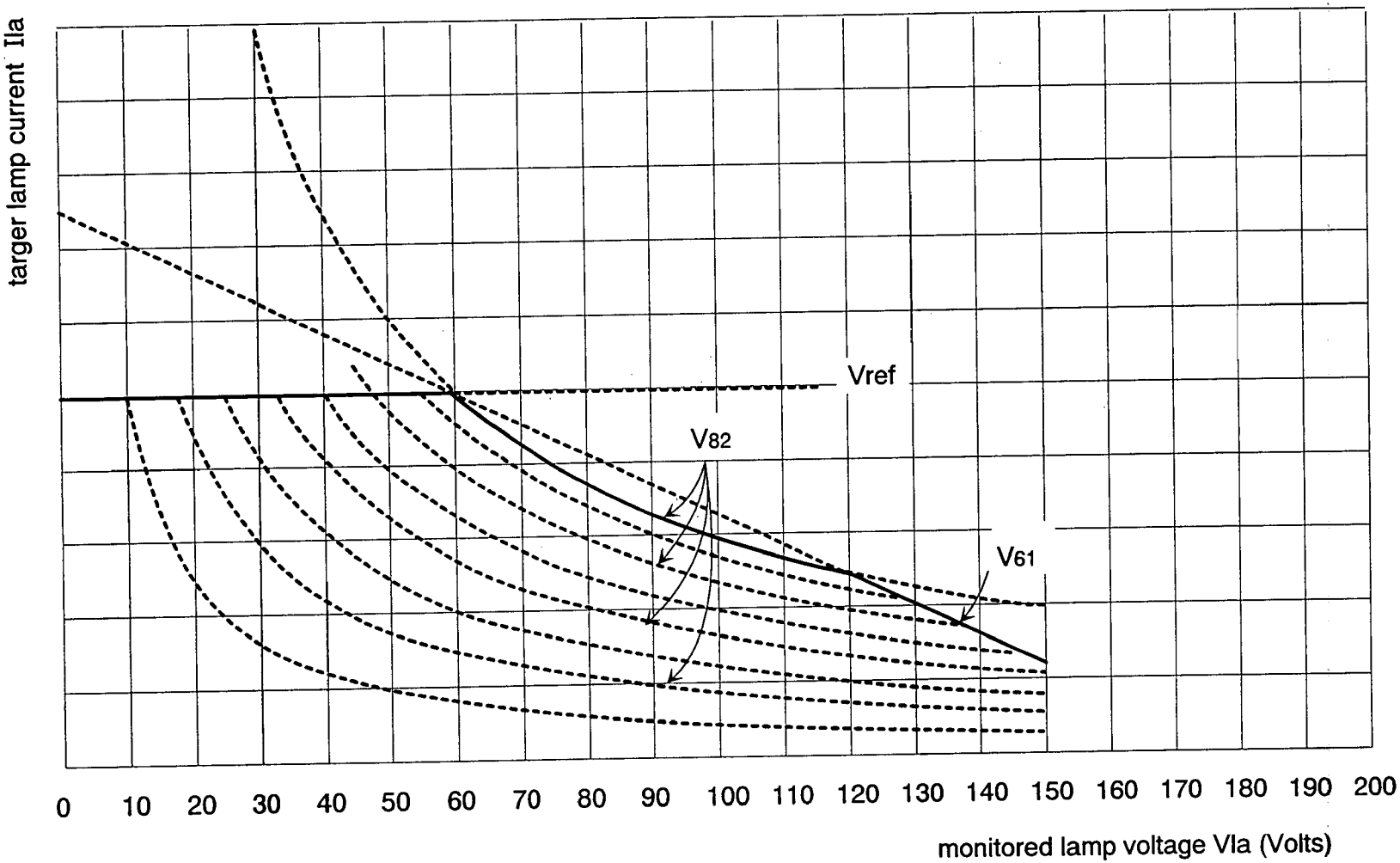
FIG. 12 is a graph illustrating the operation of the controller.
Figure 13:
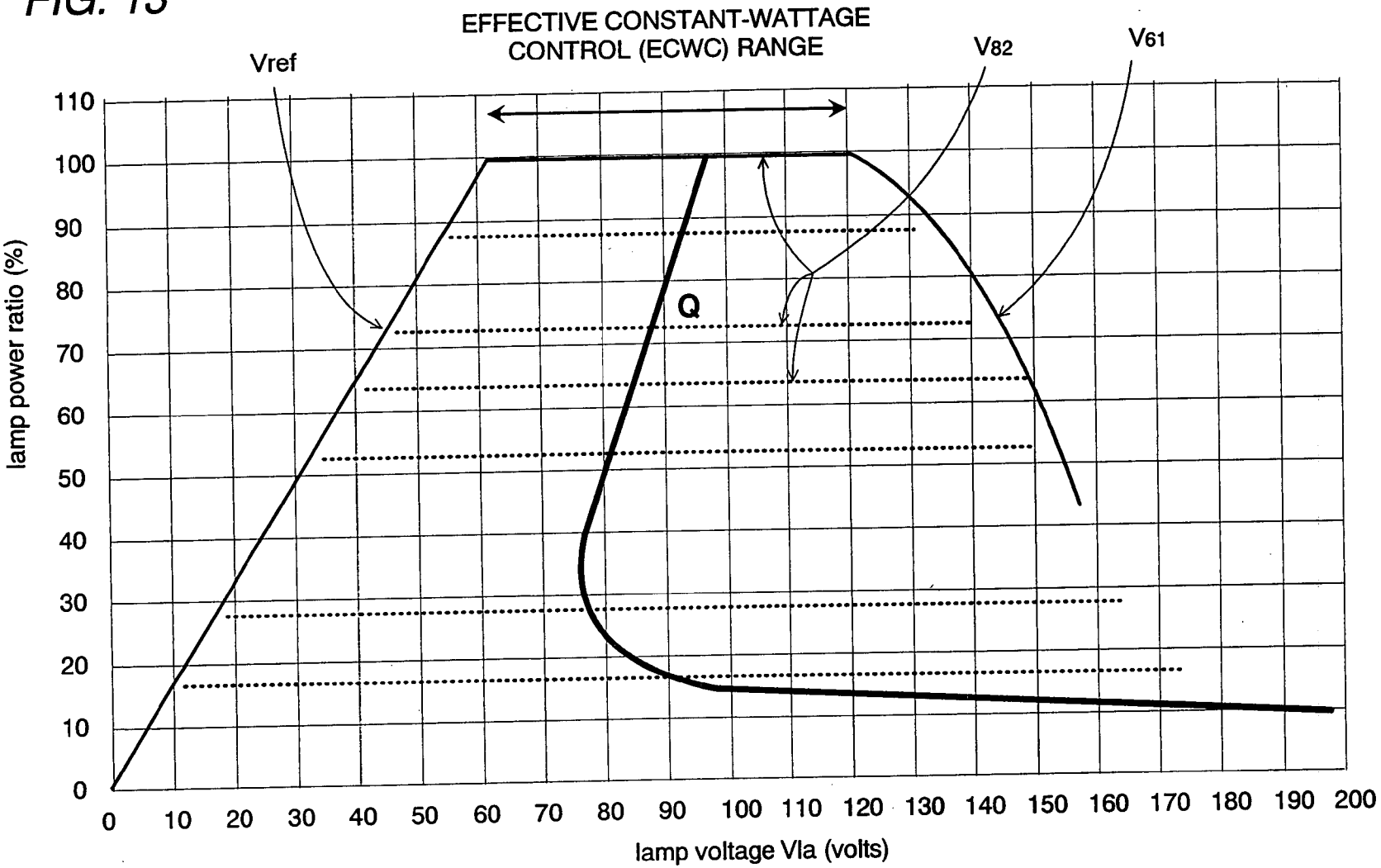
FIG. 13 is a graph illustrating the operation of the ballast.

Third Embodiment <FIGS. 11 to 13>

Referring to FIG. 11, there is shown a controller 60B for an electronic ballast in accordance with a third embodiment of the present invention. The controller 60B is basically identical in function to that of the first embodiment except for providing a ballast output characteristic having an effective constant-wattage control (ECWC) range within which the lamp power is substantially fixed irrespective of the lamp voltage variation, and of which width expands as the dimming ratio decreases with attendant decrease in the lamp power. Like parts are designated by like reference numerals with a suffix letter of "B". The controller 60B includes an amplifier 61B which provides an output V61 in proportion to a difference between the monitored lamp voltage Vla and a fixed voltage Va, and a divider 82 which divides a voltage indicative of the dimming ratio by the monitor lamp voltage Vla to provide a resulting output V82, and a voltage source 65B providing a reference voltage Vref. A lowest one of the voltages V61, Vref, and V82 is fed to a target current generator 69B which responds to give a control signal to the switch 31 of the power converter for controlling the lamp current in accordance with a voltage-current relation given by the controller, as shown in FIG. 12. In the figure, a concave curve resulting from the output V82 of the divider 82 will be lowered as the dimming ratio decreases in a direction as indicated by an arrow with an attendant increase in width below a straight inclined line resulting from output V61 and a horizontal line determined by the reference voltage Vref. With this result, the ballast realizes an output characteristic, as shown in FIG. 13, having an effective constant-wattage control (ECWC) voltage range which is defined by the output voltage V82. The range has a lower bound which decreases with the decreasing lamp voltage Vla and has an upper bound which increases with the increasing lamp voltage Vla. As is apparent from the output characteristic shown in the figure, the lamp power is substantially kept at a fixed level within ECWC range for any dimming ratio, say at the illustrated ratios of 100%, 88%, 72%, etc, thereby compensating for the lamp voltage variation within this range and assuring to give a uniform lamp power irrespective of the lamp voltage variation due to the lamp characteristic (Q) variation that may be caused by the lamp manufacturing process.

As shown in FIG. 12, the lamp current during the lamp dimming is restricted to be the lower one of the output V61 of the amplifier 61B responsible for the output characteristic in the constant-wattage control at 100% dimming ratio and the output V82 of the divider 82 responsible for the output characteristic in the constant-wattage control at any given dimming ratio. Therefore, the ballast will not generate the lamp power exceeding the rated lamp power for protecting the ballast as well as the lamp, even if there is a considerable lamp voltage increase due to the lamp characteristic variation. Otherwise, the ballast would generate an excessive lamp power in response to a high lamp voltage in a range where V82>V61, as shown in FIG. 12.

Figure 14:
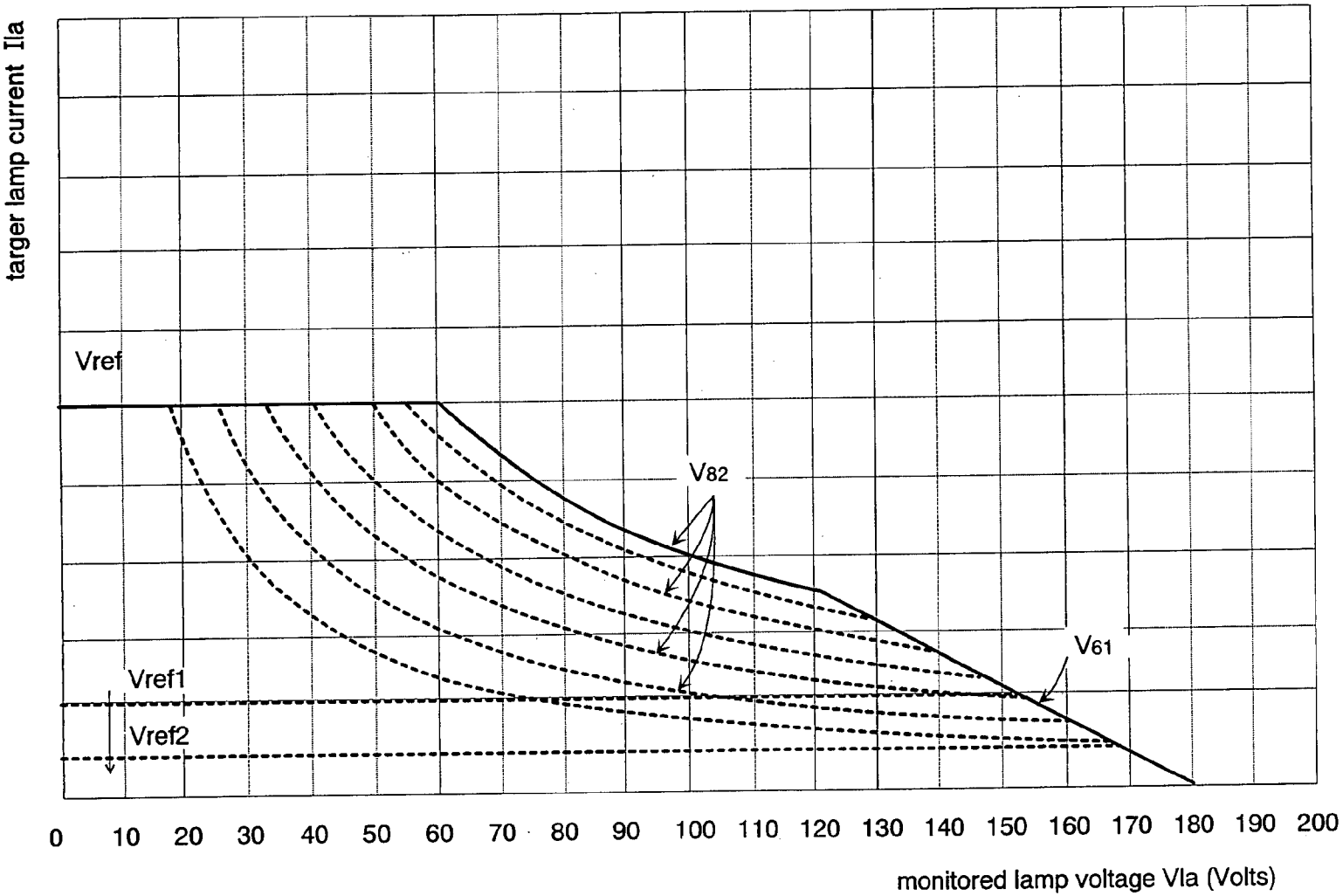
FIG. 14 is a graph illustrating the operation of a ballast in accordance with a fourth embodiment of the present invention.
Figure 15:
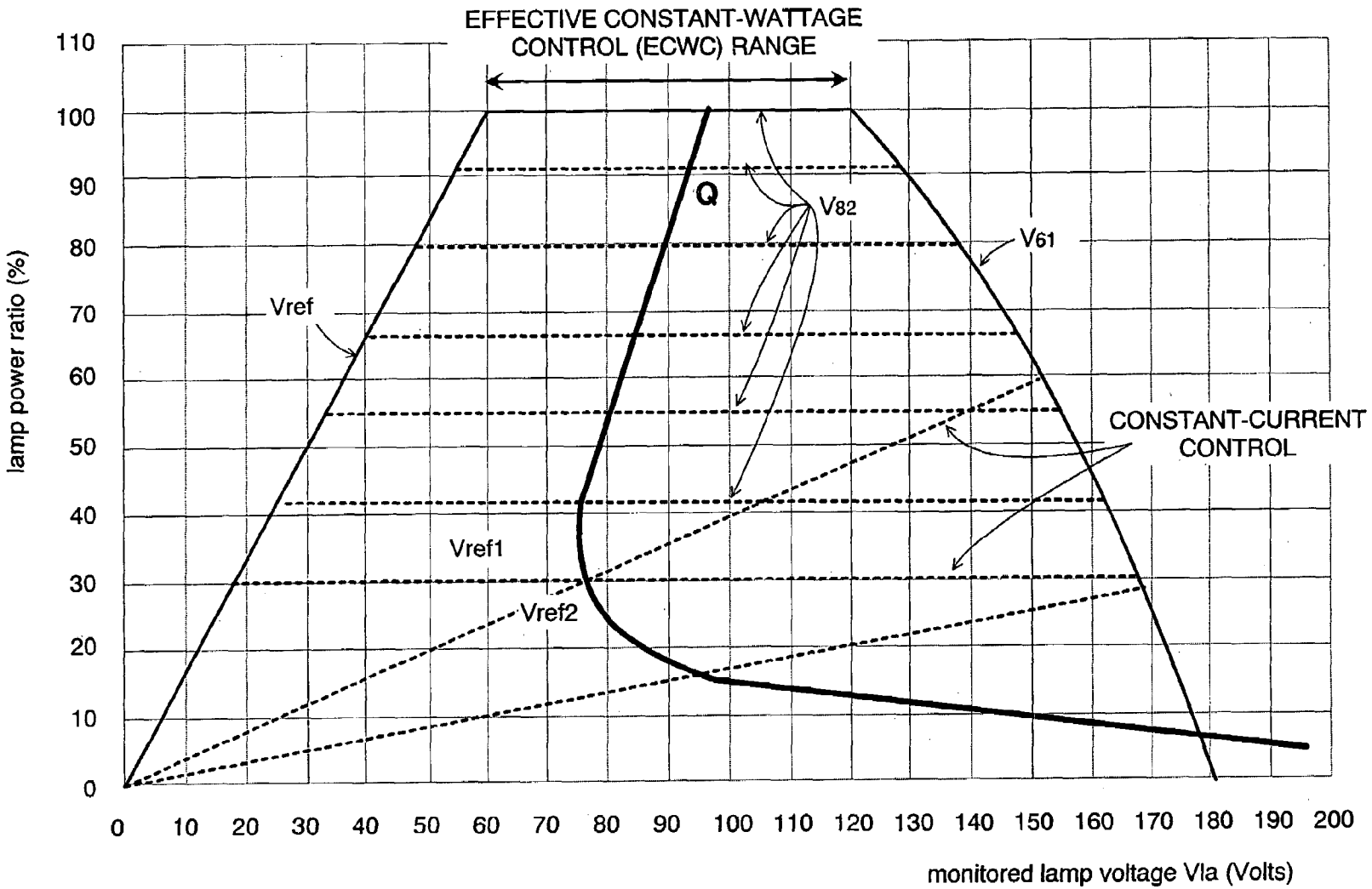
FIG. 15 is a graph illustrating the operation of the ballast.
Figure 16:
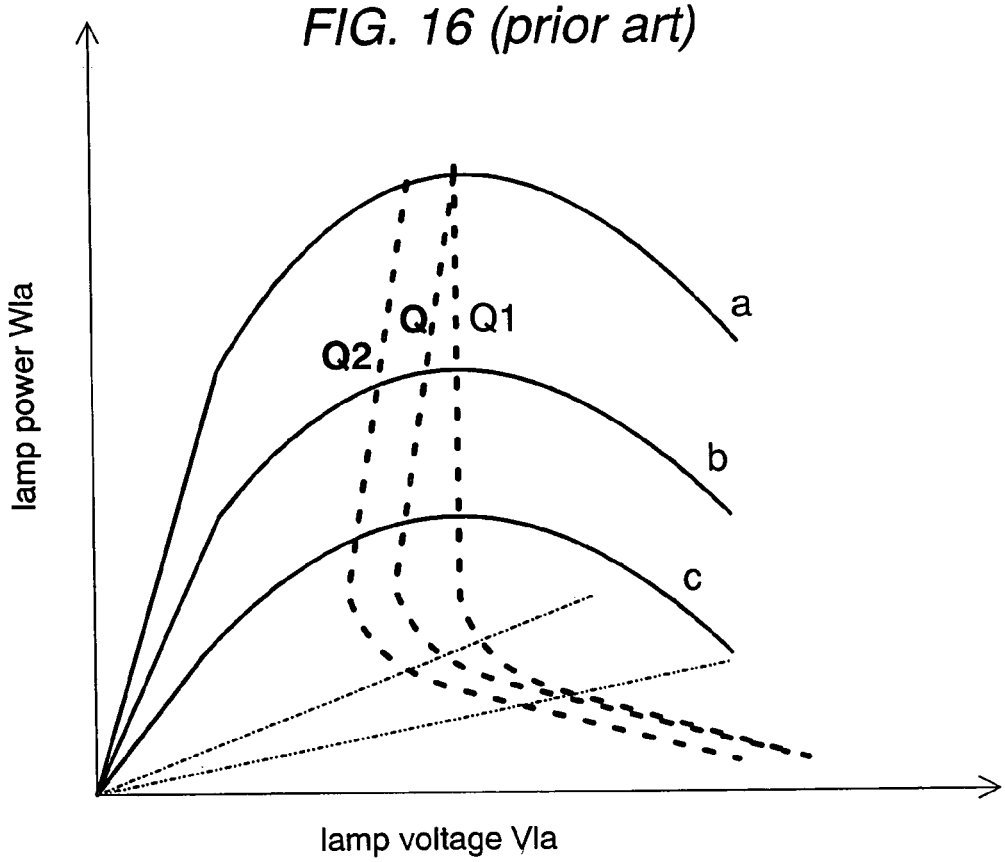
FIG. 16 (prior art)
FIGS. 16 and 17 are graphs illustrating the operations of a prior art ballast.
Figure 17:
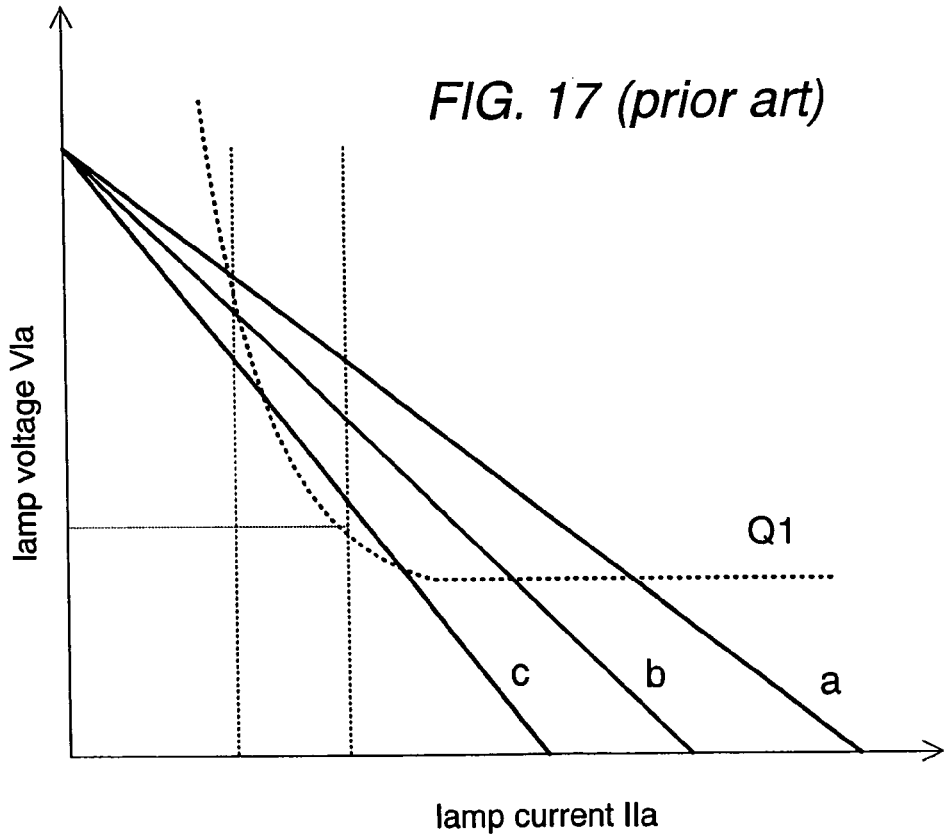
FIG. 17 (prior art)

Forth Embodiment <FIGS. 14 and 15>

FIGS. 14 and 15 show graphs illustrating an operation characteristic of a controller utilized in the ballast in accordance with a fourth embodiment of the present invention. Like references are utilized in this embodiment. The control scheme is identical to the third embodiment except that a constant current control is added for dimming the lamp to a deeper extent in the like manner as is explained with regard to the second embodiment. For this purpose, the controller is designed to have an added function of lowering the reference voltage Vref to Vref1 and Vref2, as indicated by an arrow in FIG. 14, after the dimming ratio decreases past a critical level, for example, 30% below which it is expected that the lamp voltage turns to increase with the decrease in the lamp power. That is, until the dimming ratio decreases to the critical level, the constant-wattage control is relied on to provide the effective constant-wattage control (ECWC) voltage range which is defined by the output voltage V82 and is of generally flat output characteristic as indicted by horizontal dotted lines in FIG. 15. As the dimming ratio is lowered past the critical level, the constant current control takes over to provide an output characteristic as indicted by dotted inclined lines in FIG. 15. Therefore, it is readily possible to make the deep lamp dimming down through the critical level below which the lamp characteristic exhibits the lamp voltage increase with the decreasing lamp power, since the lines (Vref1 and Vref2) of the output characteristic in the constant current control will intersect the lamp characteristic Q at steep angles, as is clear from FIG. 15.

Also in the embodiment, even if there is seen a considerable lamp voltage increase due to the lamp characteristic variation, the lamp power given in the constant current control is restricted not to exceed the rated lamp power, as is known from the relation shown in FIG. 15 that the lines Vref1 and Vref2 will not extend through a curve defined by the output V61, which is in turn known from a relation shown in FIG. 14 that the lamp current defined by the output V82 does not exceed the lamp current defined by the output V61 in a high lamp voltage range.

It is noted here that the second and fourth embodiments are explained to rely upon the particular dimming ratio for switching the constant-wattage control to the constant current control in match with the lamp characteristic that the lamp voltage decreases with the reducing lamp power to some level and then turns to increase with the further reducing lamp power. However, it is equally possible to rely on the actual lamp voltage being monitored during the lamp dimming in order to determine a critical point around which the lamp voltage turns to increase with the further decrease in the lamp power, for the purpose of switching the constant-wattage control to the constant current control. Therefore, it is also within the scope of the present invention that the controller determines, based upon the monitored lamp voltage, the critical point below which the lamp voltage increased with the decreasing lamp power and switches the constant-wattage control into the constant current control in response to the determination of the critical point.

The above particular embodiments are made only for the purpose of describing the essence of the present invention and not limiting the present invention thereto. Therefore, the present invention can encompass any combination of the individual features of the embodiments.

This application is based upon and claims the priority of Japanese Patent Application No. 2001-178898 filed in Japan on Jun. 13, 2001, the entire contents of which are expressly incorporated by reference herein.

What is claimed is:

1. An electronic ballast for a high intensity discharge lamp, said ballast comprising:

a power converter which converts an input DC voltage into a lamp power for driving the high intensity discharge lamp;

a dimmer which provides a dimmer command of a varying dimming ratio in order to reduce the lamp power for dimming the lamp to a deeper extent as the dimming ratio decreases;

a voltage monitor which monitors a lamp voltage across said discharge lamp;

a controller which controls said power converter to provide a voltage-wattage output characteristic which gives the lamp power varying with the varying lamp voltage being monitored, said controller receiving said dimmer command to provide said voltage-wattage output characteristic which lowers the lamp power for the given monitored lamp voltage as said dimming ratio decreases;

said voltage-wattage output characteristic defining an effective constant wattage control (ECWC) voltage range within which said power converter is controlled to give a roughly constant lamp power while allowing only a small lamp power error from a maximum lamp power when the monitored lamp voltage varies between a lower bound and an upper bound of said ECWC voltage range, wherein said controller operates to modify said voltage-wattage output characteristic in such a manner as to lower the lower bound of said ECWC voltage range as said dimming ratio decreases down from 100% at which a rated power is supplied to the discharge lamp.

2. The ballast as set forth in claim 1, wherein said lamp power error corresponds to about 5% or less of the maximum lamp power intended by the given dimming ratio.

3. The ballast as set forth in claim 1, wherein said controller operates to lower the lower bound of said ECWC voltage range until said dimming ratio decreases to a predetermined level below which the lamp voltage of said lamp turns to increase with a further decreasing of the lamp power.

4. The ballast as set forth in claim 1, wherein said controller gives the ECWC voltage range of which lower bound is shifted by approximately 20 V when the dimming ratio decreases from 100% to 50%.

5. The ballast as set forth in claim 1, wherein said controller controls said power converter to provide a constant current control for supplying to the discharge lamp a constant current determined by the dimming ratio, said controller switching said constant wattage control to said constant current control after the dimming ratio decreases past a predetermined level.

6. The ballast as set forth in claim 5, wherein said predetermined level is selected to correspond to a lamp power above which the lamp voltage increases with the decreasing lamp power and below which the lamp voltage increases with the decreasing lamp power.

7. The ballast as set forth in claim 6, wherein said predetermined level is defined by the dimming ratio of within 30% to 50%.

8. The ballast as set forth in claim 5, wherein said constant current control restricts the constant current determined by the dimming ratio such that the constant current gives a resulting lamp power not exceeding the lamp power given to the discharge lamp when it is operated at the dimming ratio of 100%.

9. The ballast as set forth in claim 1, wherein said controller gives said effective constant wattage control (ECWC) voltage range having a width which increases as the dimming ratio decreases from 100%.

10. The ballast as set forth in claim 9, wherein said controller gives said effective constant wattage control (ECWC) voltage range within which the lamp power is substantially fixed irrespective of the lamp voltage varying from the lower bound to the upper bound.

11. The ballast as set forth in claim 9, wherein said controller restricts the lamp power in the course of dimming the discharge lamp such that the lamp power, which is given to the discharge lamp as corresponding to the lamp voltage varying with the dimming ratio, does not exceed the lamp power given to the lamp when it is operated at the dimming ratio of 100%.

12. The ballast as set forth in claim 9, wherein said controller controls said power converter to provide a constant current control for supplying to the discharge lamp a constant current determined as corresponding to the instant lamp voltage being monitored, said controller switching said constant wattage control to said constant current control after the dimming ratio decreases past a predetermined level.

13. The ballast as set forth in claim 12, wherein said predetermined level is selected to correspond to a lamp power above which the lamp voltage increases with the decreasing lamp power and below which the lamp voltage increases with the decreasing lamp power.

14. The ballast as set forth in claim 13, wherein said predetermined level is defined by the dimming ratio of within 30% to 50%.

15. The ballast as set forth in claim 12, wherein said constant current control restricts the constant current determined by the dimming ratio such that the constant current gives a resulting lamp power not exceeding the lamp wattage given to the discharge lamp when it is operated at the dimming ratio of 100%.

* * * * *